US006250743B1

(12) United States Patent
Uno et al.

(10) Patent No.: US 6,250,743 B1
(45) Date of Patent: Jun. 26, 2001

(54) TANDEM TYPE OF DIRECT PRINTING APPARATUS USING GATING APERTURES FOR SUPPLYING TONER

(75) Inventors: Koji Uno, Kobe; Toshio Yamaki, Takatsuki; Hirokatsu Shimada, Machida; Yoshifumi Shibata; Hiroshi Hiraguchi, both of Toyokawa, all of (JP)

(73) Assignees: Minolta Co., Ltd., Osaka (JP); Array Printers AB, Vastra Frolunda (SE)

( * ) Notice: Subject to any disclaimer, the term of this patent is extended or adjusted under 35 U.S.C. 154(b) by 0 days.

(21) Appl. No.: 09/212,205

(22) Filed: Dec. 16, 1998

(30) Foreign Application Priority Data

Dec. 22, 1997 (JP) ..... 9-352795

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158, 116, 117, 115, 73, 199; 399/271, 290, 293, 294, 295, 184, 308, 302, 222

(56) References Cited

U.S. PATENT DOCUMENTS 5,477,250 12/1995 Larson .
5,606,402 * 2/1997 Fujita ..... 347/55
5,880,760 * 3/1999 Desie et al. ..... 347/55

FOREIGN PATENT DOCUMENTS 0710895 5/1996 (EP) .
0790538 8/1997 (EP) .

* cited by examiner

*Primary Examiner*—John Barlow
*Assistant Examiner*—Raquel Yvette Gordon
(74) *Attorney, Agent, or Firm*—Morrison & Foerster LLP

(57) ABSTRACT

A tandem type direct printing apparatus 2 comprising a plurality of printing stations 16*a*, 16*b*, 16*c* and 16*d* for depositing printing particles 38 on a print medium 8 to form a layer of printing particles. The plurality of printing stations 16*a*, 16*b*, 16*c* and 16*d* are positioned in a moving direction of the print medium 8. The printing station positioned downstream with respect to the moving direction of the print medium forms a layer of printing particles on the layer of printing particles formed by the printing station positioned upstream. At least any one of the printing stations 16*a*, 16*b*, 16*c* and 16*d* is different in intention of the electric field from another by changing the voltage applied to the backing electrode 44 or the distance between the backing electrode 44 and the printing head 50 in accordance with a charge quantity of printing particles or the number of the layer of printing particles in the one of the printing stations.

9 Claims, 9 Drawing Sheets

| | | | | |
|---|---|---|---|---|
| Color of Toner | Black | Yellow | Cyan | Magenta |
| Charge Quantity of Toner | Large | Middle | Small | Small |
| Voltage $V_{BE}$ | Vd (1500V) > | Vc (1200V) > | Vb (1000V) = | Va (1000V) |
| Intensity of Electric Field | Ed > | Ec > | Eb = | Ea |

| | | | | |
|---|---|---|---|---|
| Color of Toner | Black | Yellow | Cyan | Magenta |
| Charge Quantity of Toner | Large | Middle | Small | Small |
| Distance $l_i$ | ld (300 $\mu$m) < | lc (400 $\mu$m) < | lb (500 $\mu$m) = | la (500 $\mu$m) |
| Intensity of Electric Field | Ed > | Ec > | Eb = | Ea |

| | | | | |
|---|---|---|---|---|
| Number of Toner Layer | 3 | 2 | 1 | 0 |
| Voltage $V_{BE}$ | Vd (1300V) > | Vc (1200V) > | Vb (1100V) > | Va (1000V) |
| Intensity of Electric Field | Ed > | Ec > | Eb > | Ea |

| | | | | |
|---|---|---|---|---|
| Number of Toner Layer | 3 | 2 | 1 | 0 |
| Distance $l_i$ | ld (350 μm) < | lc (400 μm) < | lb (450 μm) < | la (500 μm) |
| Intensity of Electric Field | Ed > | Ec > | Eb > | Ea |

TANDEM TYPE OF DIRECT PRINTING APPARATUS USING GATING APERTURES FOR SUPPLYING TONER

This application is based on application No. H9-352795 filed in Japan on Dec. 22, 1997, the content of which is hereby incorporated by reference.

FIELD OF THE INVENTION

The present invention relates to a tandem type of direct printing apparatus for use in a color copying machine and printer.

BACKGROUND OF THE INVENTION

U.S. Pat. No. 5,477,250 issued on Dec. 19, 1995 discloses a tandem type of direct printing apparatus. In the direct printing apparatus, four printing stations are disposed along a sheet conveying direction. Each printing station comprises a toner carrier retaining toner on its outer periphery, a backing electrode opposed to the toner carrier and a printing head disposed between the toner carrier and the backing electrode, the printing head having a plurality of apertures and a plurality of electrodes surrounding each aperture. On the outer periphery of the toner carrier in each printing station are retained toner having different colors, for example, magenta, cyan, yellow and black. The backing electrode of each printing station is electrically connected to a power source, thereby between the toner carrier and the backing electrode is formed an electric field for attracting the toner on the toner carrier and propelling it toward the backing electrode through the apertures of the printing head. Between the printing head and the backing electrode in each printing station is formed a passage for a sheet.

When an ON voltage is applied to the electrode of the printing head in the printing station positioned at the most upstream side in the sheet conveying direction, for example, the magenta printing station, the toner attracting force due to the electric field between the toner carrier and the backing electrode propels the toner on the toner carrier through the apertures toward the backing electrode and adheres it to the sheet. When an OFF voltage is applied to the electrode of the printing head, the toner attracting force does not affect the toner on the toner carrier, whereby the toner is never propelled. Thus, when ON and OFF voltage applied to the electrode of the printing head are controlled on the basis of a desired image signal, a magenta image corresponding to the image signal is printed on the sheet. In the same manner, by controlling the ON and OFF voltage applied to the electrode of the printing head in each of the downstream printing stations a different color of image is laid on the previously printed image to form a desired image.

In the aforementioned tandem type of direct printing apparatus, since the different color of the toner is retained on the toner carrier of each printing station, the electric charge quantity of the toner is different at each printing station, causing variance of the toner retaining force on the surface of the toner carrier. Moreover, the printing station at the most upstream side in the sheet conveying direction performs print on the sheet surface where the toner is not adhered yet, while the printing station at the downstream side performs print again on the toner adhered to the sheet surface by the upstream printing station. Thus, the laminated condition of the toner is different at each printing station, causing variance of the attracting force due to the electric field between the toner carrier and the backing electrode. The variance of both the toner retaining force and the attracting force also causes variance of characteristic that toner is detached from the toner carrier and propelled by the attracting force due to the electric field between the toner carrier and the backing electrode, i.e. transferability at each printing station, resulting in a disadvantage that desirable image is difficult to obtain.

SUMMARY OF THE INVENTION

Accordingly, the present invention has been accomplished to solve the aforementioned disadvantages of the prior arts. An object of the present invention is to provide a tandem type of direct printing apparatus having a high transferability in spite of variance of printing particle retaining force and attracting force at each printing station.

In order to achieve the aforementioned object, according to the present invention, there is provided a tandem type direct printing apparatus comprising a plurality of printing stations for depositing printing particles on a print medium to form a layer of printing particles, the plurality of printing stations being positioned in a moving direction of the print medium, the printing station positioned downstream with respect to the moving direction of the print medium forming a layer of printing particles on the layer of printing particles formed by the printing station positioned upstream, the printing station comprising:

- a bearing member for bearing charged printing particles thereon;
- a backing electrode opposed to the bearing member;
- a power supply connected to the backing electrode for generating an electric field that attract the charged printing particles on the bearing member to propel the same toward said backing electrode;
- a printing head disposed between the bearing member and the backing electrode, the printing head having a plurality of apertures through which the printing particles can propel and a plurality of electrodes disposed around the plurality of apertures; and
- a driver for applying the plurality of electrode with a voltage for allowing the printing particles to be propelled and a voltage for forbidding the printing particles to be propelled in response to an image signal;
- wherein at least any one of the printing stations is different in intention of the electric field from another in accordance with a charge quantity of printing particles or the number of the layer of printing particles in the one of the printing stations.

In the tandem type direct printing apparatus of the present invention having such construction as described above, each printing stations is different in intention of the electric field in accordance with the charge quantity of printing particles or the number of the layer of printing particles. In the concrete, the intensity of the electric field in the printing station using a small charge quantity of printing particles is made small, while the intensity of the electric field in the printing station using a large charge quantity of printing particles is made large. Thus, even though there is a variance of printing particle retaining force due to the difference in charge quantity of the printing particles at each printing station, the transferability that the printing particles are detached from the carrying member and propelled is same at each printing station. Alternatively, the intensity of the electric field in the upstream printing station in which the print medium has a small number of the layer of printing particles is made small, while the intensity of the electric field in the printing station in which the print medium has a large number of the layer of printing particles is made large.

Thus, the variance of the attracting force due to the difference in the number of the layer of printing particles disappears, thereby the transferability is same at each printing station.

As the intensity of the electric field at each printing station has parameters of the voltage applied to the backing electrode by the power supply and the distance between the backing electrode and the printing head, the intention of the electric field in each printing stations is preferably different from one another by changing such parameters.

Preferably, the printing medium may be a sheet which is conveyed through a pass formed between the backing electrode and the printing head. In this case, the sheet may be conveyed by an endless belt type of conveyance belt or an cylindrical type of conveyance drum.

Preferably, the printing medium may be an intermediate transfer member which is conveyed through a pass formed between the backing electrode and the printing head and the apparatus may further comprise a transfer roller which comes into pressure contact with the intermediate transfer roller to transfer the layer of printing particles formed on the intermediate transfer roller onto a sheet. In this case, the intermediate transfer member may be an endless belt type of intermediate transfer belt or a cylindrical type of intermediate transfer drum.

BRIEF DESCRIPTION OF THE DRAWINGS

Further objects and advantages of the present invention will be become clear from the following description taken in conjunction with the preferred embodiments thereof with reference to the accompanying drawings, in which.

DETAILED DESCRIPTION OF THE PREFERRED EMBODIMENTS

Figure 1:
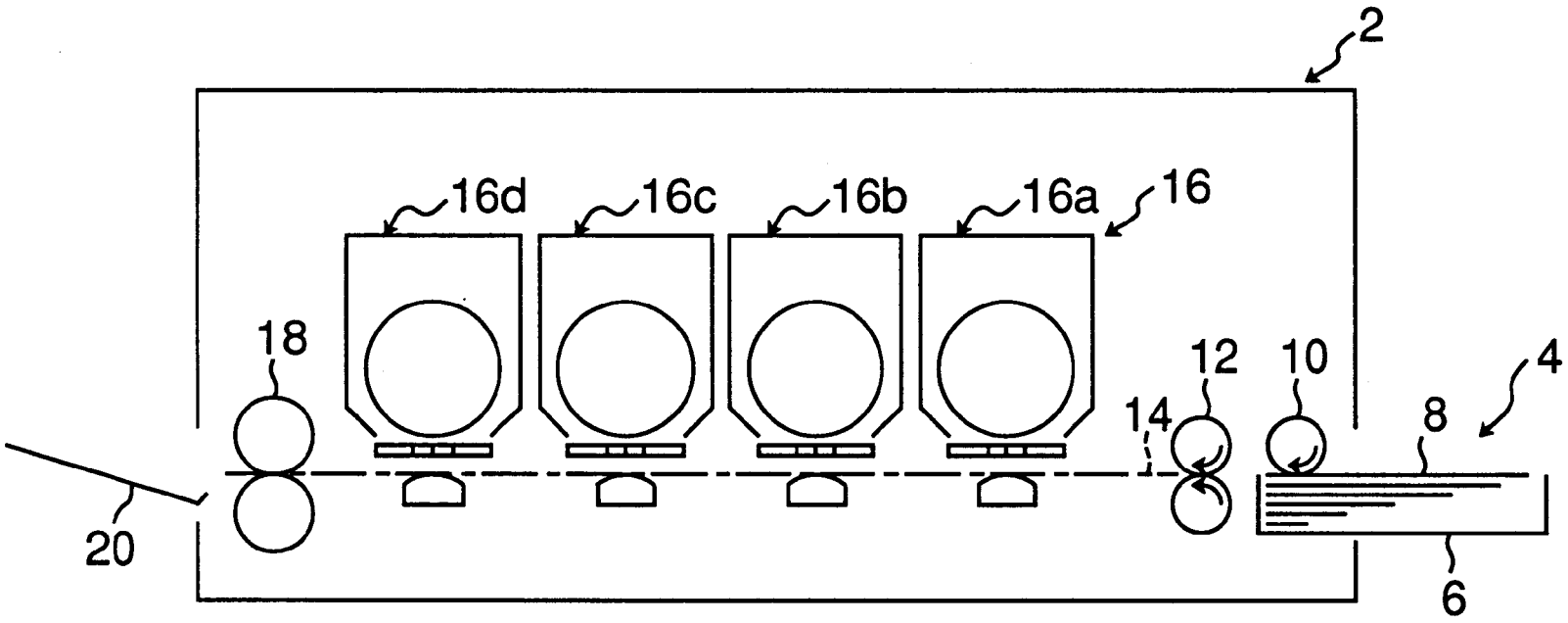
FIG. 1 is a schematic cross-sectional side elevational view of a first embodiment of a tandem type direct printing apparatus of the present invention.

With reference to the drawings and, in particular, to FIG. 1, there is shown a tandem type of direct printing device, generally indicated by reference numeral 2, according to a first embodiment of the present invention. The printing device 2 has a sheet feed station generally indicated by reference numeral 4. The sheet feed station 4 includes a cassette 6 in which a number of sheets 8 or plain papers are stacked. A sheet feed roller 10 is mounted for rotation above the cassette 6 so that it can frictionally contact with the top sheet 8, thereby the feed roller 10 can feed the top sheet 8 into the direct printing device 2 as it rotates. A pair of timing rollers 12 are arranged adjacent to the sheet feed roller 10, for supplying the sheet 8 fed from the cassette 6 through a sheet passage 14 indicated by a dotted line into a printing station, generally indicated by reference numeral 16, where a printing material is deposited on the sheet to form an image thereon. Further, the printing device 2 includes a fusing station 18 for fusing and permanently fixing the image of printing material on the sheet 8, and a final stack station 20 for catching the sheets 8 on which the image has been fixed.

The printing station 16 comprises four printing stations 16*a*, 16*b*, 16*c* and 16*d* equally spaced along the sheet passage 14. These printing stations 16*a*, 16*b*, 16*c* and 16*d* have essentially same construction respectively and therefore one printing station, for example, the printing station 16a positioned at the most upstream side in the sheet passage 14 will be explained hereinafter.

Figure 2:
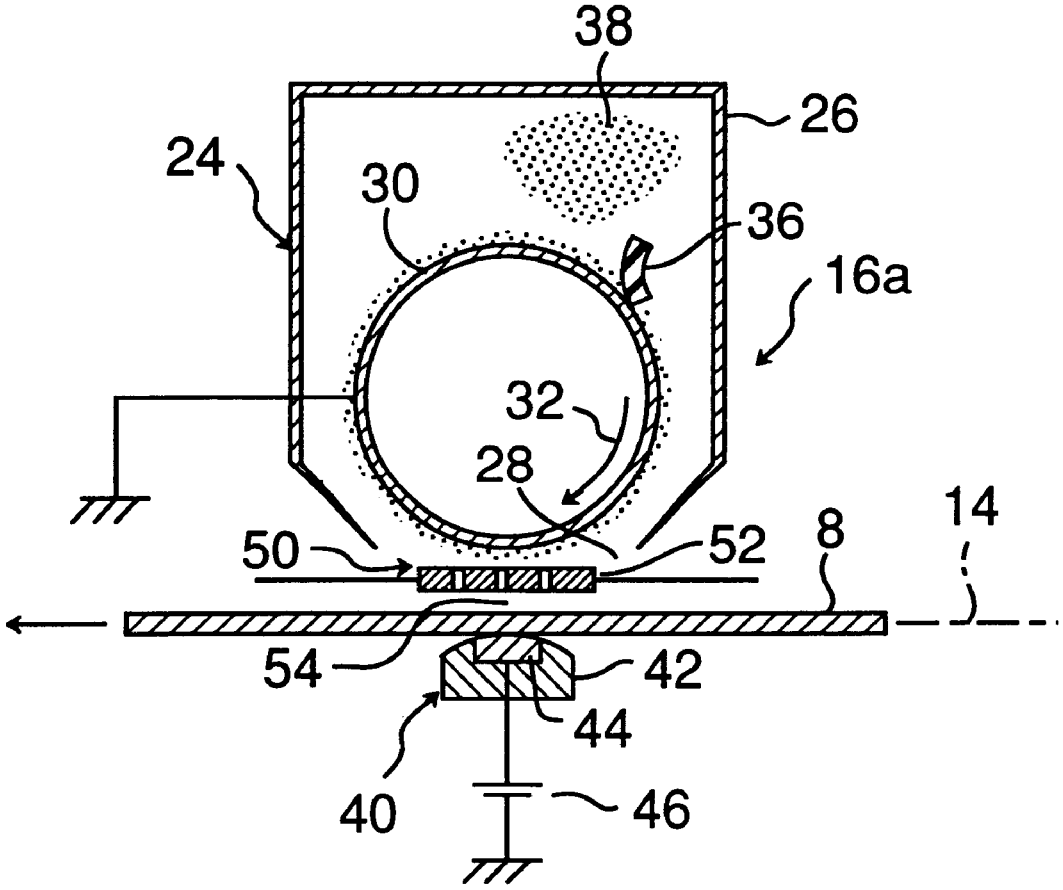
FIG. 2 is a cross-sectional side elevational view of a printing station.

Referring to FIG. 2, the printing station 16*a* comprises a developing device generally indicated by reference numeral 24 above the sheet passage 14. The developing device 24 comprises a container 26 which has an opening 28 confronting the sheet passage 14. Adjacent the opening 28, a developing roller 30 as a bearing member of printing particles according to the present invention is supported for rotation in a direction indicated by an arrow 32. The developing roller 30 is made of conductive material and is electrically connected to the earth. A blade 36, preferably made from a plate of elastic material such as rubber or stainless steel, is disposed in contact with the developing roller 30.

The container 26 accommodates printing particles, i.e., toner particles 38. In this embodiment, the toner particles capable of being charged with negative polarity by the contact with the blade 36 are used. The color of the toner particles 38 at each of the printing stations 16*a*, 16*b*, 16*c* and 16*d* is different from each other. For example, the color of the toner particles 38 is magenta at the printing station 16*a*, cyan at the printing station 16*b*, yellow at the printing station 16*c* and black at printing station 16*d*, thereby color printing is possible.

Disposed under the developing device 24, beyond the sheet passage 14, is an electrode mechanism generally indicated by reference numeral 40 which includes a support 42 made of electrically insulative material and a backing electrode 44 made of electrically conductive material. The backing electrode 44 is electrically connected to a direct power supply 46 which supplies a voltage of predetermined polarity (positive polarity in this embodiment) so that the backing electrode 44 is provided with, for example, a voltage of +1200 volts. Thus, between the backing electrode 44 and the developing roller 30 are formed an electric field E that the negatively charged toner particles 38 on the developing roller 30 are electrically attracted to the backing electrode 44.

Figure 3:
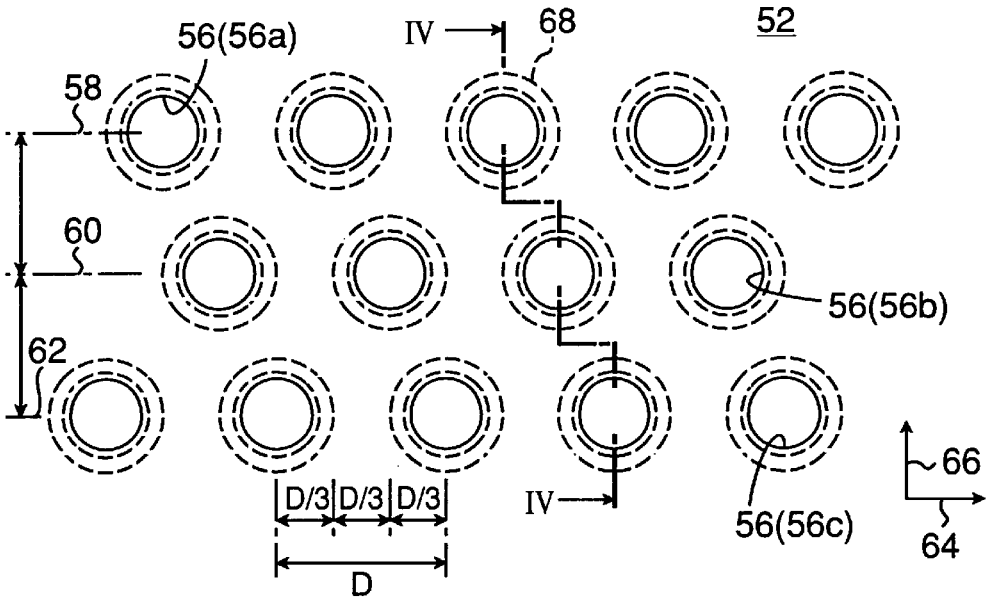
FIG. 3 is an enlarged fragmentary plane view of a printing head.

Fixed between the developing device 24 and the electrode mechanism 40 and above the sheet passage 14 is a printing head generally indicated by reference numeral 50. Preferably, the printing head 50 is made from a flexible printed circuit board 52, having a thickness of about 50 to 150 micrometers. As shown in FIGS. 2 and 3, a portion of the printing head 50 located in a printing zone where the developing roller 30 confronts the backing electrode 44 includes a plurality of apertures 56 having a diameter of about 25 to 200 micrometers which is substantially larger than an average diameter (about several micrometers to a dozen micrometers) of the toner particles 38.

In this embodiment, as best shown in FIG. 3, the apertures 56 are formed on equally spaced three parallel lines 58, 60 and 62 each extending in a direction indicated by reference numeral 64 which is parallel to an axis of the developing roller 30 and perpendicular to a direction indicated by reference numeral 66 along which the sheet 8 will be transported, ensuring the printing head 50 with a resolution of 600 dpi. The apertures 56 on the lines 58, 60 and 62 are formed at regular intervals of D, e.g., 127 micrometers, and the apertures 56(56*a*) and 56(56*c*) on the lines 58 and 62 are shifted by the distance D/N to the opposite directions with respect the apertures 56(56*b*) on the central line 60, respectively, so that, when viewed from the sheet transporting direction 66, the apertures 56 appear to be equally spaced. Note that the number N represents the number of line rows and is "3" in this embodiment, however, the number N as well as the interval D can be determined depending upon the required resolution of the print head.

The flexible printed circuit board 52 further includes therein doughnut-like first and second electrodes 68 and 70 each of which surrounding the apertures 56. The first electrode 68 is disposed on one side opposing the developing roller 30 while the second electrode 70 is on the other side opposing the backing electrode 44.

The first electrode 68 is electrically communicated with a driver 72 through a printed wire 74 and the second electrode 70 is electrically communicated with a driver 76 through a printed wire 78, so that the drivers 72 and 76 can transmit image signals to the first and second electrodes 68 and 70, respectively. The drivers 72 and 76 are in turn electrically communicated with a controller 80 that feeds out data of image to be reproduced by the printing device 2.

The image signals to be transmitted to the first and second electrodes 68 and 70 consist of a DC component constantly applied to the first and second electrodes 68, 70 and a pulse component applied to the first and second electrodes 68, 70 in response to the image data from the controller 80 for forming dots on the sheet 8.

In the concrete, in this embodiment, for the first electrode 68, the base voltage V1 (B) is about −50 volts, and the pulse voltage V1 (P) is about +300 volts. For the second electrode 70, the base voltage V2 (B) is about −100 volts and the pulse voltage V2 (P) is about +200 volts.

Figure 5:
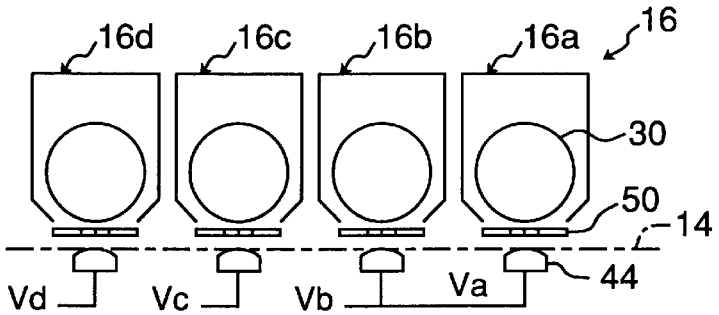
FIG. 5 is schematic cross-sectional side elevational view of the printing stations showing a condition that a voltage applied to the backing electrode is varied in accordance with a charge quantity of printing particles at each printing station.

The intensity of the electric field E generated between the developing roller 30 and the backing electrode 44 is different from each other at the printing stations 16*a*, 16*b*, 16*c* and 16*d* in accordance with the charge quantity of the toner particles 38 at each of the printing stations 16*a*, 16*b*, 16*c* and 16*d*. As a parameter of the intensity of the electric field E, in this embodiment, the voltage $V_{BE}$ applied to the backing electrode 44 is used. That is to say, as shown in FIG. 5, the voltage Va, Vb applied to the upstream-side first and second printing stations 16*a*, 16*b* respectively in which magenta, cyan toner particles 38 of small charge quantity are used respectively are set at same values. The voltage Vc applied to the downstream-side third printing stations 16*c* in which yellow toner particles 38 of middle charge quantity is used is set at a larger value than the voltage Va, Vb in the upstreamside first and second printing stations 16*a*, 16*b*. Moreover, the voltage Vd applied to the most downstream-side fourth printing stations 16*d* in which black toner particles 38 of large charge quantity is used is set at a larger value than the voltage Vc in the upstream-side third printing stations 16*c*.

Having described the construction of the printing device 2, its operation will now be described.

Figure 4:
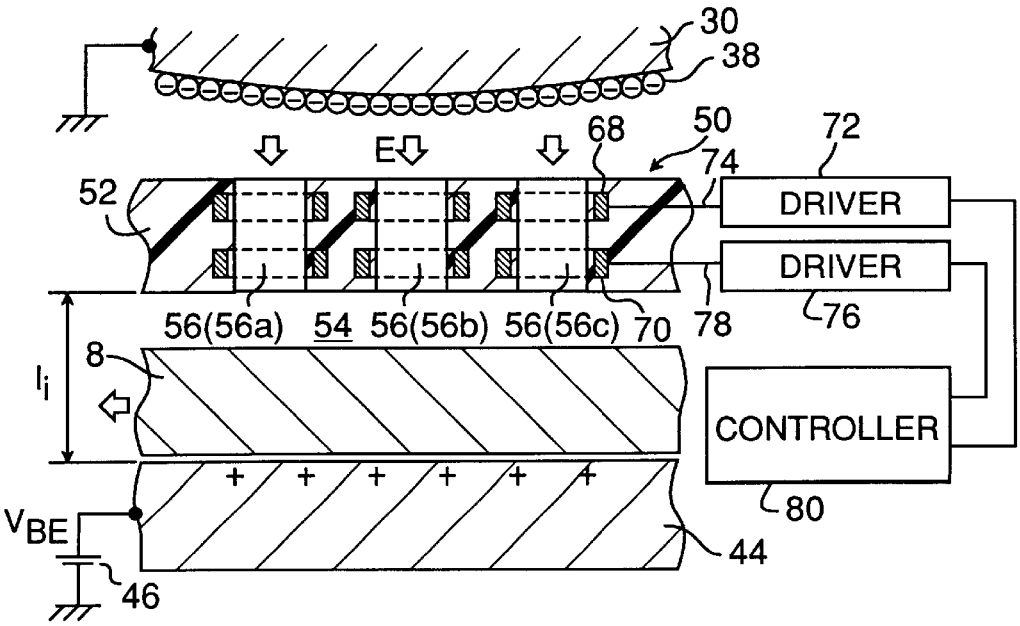
FIG. 4 is an enlarged fragmentary cross-sectional view of the printing head, developing roller and backing electrode taken along a line IV—IV in FIG. 3.

As shown in FIG. 2, in the first printing station 16*a*, the developing roller 30 rotates in the direction indicated by the arrow 32. The toner particles 38 are deposited on the developing roller 30 and then transported by the rotation of the developing roller 30 into a contact region of the blade 36 and the developing roller 30 where the toner particles 38 are provided with triboelectric negative charge by the frictional contact of the blade 36. Thereby, as shown in FIG. 4, incremental peripheral portions of. the developing roller 30 which has passed through the contact region bear a thin layer of charged toner particles 38.

In the printing head 50, the first and second electrodes 68 and 70 are constantly biased to the base voltage V1 (B) of about −50 volts and V2 (B) of about −100 volts. Therefore, the negatively charge toner particle 38 on the developing roller 30 electrically repels against the first and second electrodes 68 and 70 and therefore stays on the developing roller 30 without propelling toward the aperture 56.

The controller 80 outputs the image data corresponding to a magenta image to be reproduced to the drivers 72 and 76. In response to the image data, the drivers 72 and 76 supplies the respective voltages V1 (P) of about +300 volts and V2 (P) of about +200 volts to the pairs of first and second electrodes 68 and 70. As a result, the toner particles 38 on the portions of the developing roller 30 confronting the biased electrodes are electrically attracted by the first and second electrodes 68 and 70. This energizes a number of toner particles 38 to propel by the attraction force of the backing electrode 44 into the opposing aperture 56.

When the toner particles 38 have reached respective positions adjacent to the first and second electrodes 68 and 70, the voltages to be applied to the first and second electrodes 68 and 70 are changed from the pulse voltages V1 (P) and V2 (P) to base voltages V1 (B) and V2 (B), at respective timings. As a result, the toner particles 38 in the aperture 56 are then forced radially inwardly by the repelling force from the first and second electrodes 68 and 70 applied with the base voltages V1 (B) and V2 (B), respectively, and then converged into a mass. The converged mass of the toner particles 38 are then deposited on the sheet 8 which is moving past the printing zone 54, thereby forming a layer of the magenta toner particles on the sheet 8. The aforementioned second electrode 70 is provided mainly for the purpose of converging the mass of the toner particles 38. Therefore, the second electrode 70 can be excluded if necessary.

In the same manner, in the second printing station 16*b*, a layer of cyan toner particles is formed over the layer of magenta toner particles formed by the first printing station 16*a*. Then, in the third printing station 16*c*, a layer of yellow toner particles is formed over the layer of cyan toner particles formed by the second printing station 16*b*. Finally, in the fourth printing station 16*d*, a layer of black toner particles is formed over the layer of yellow toner particles formed by the third printing station 16*c*. Thus, a desired color image is formed on the sheet 8.

As a different charge quantity of toner particles 38 is used in the printing stations 16*a*, 16*b*, 16*c* and 16*d* respectively, there is a variance of the retaining force of the printing particles 38 on the developing roller 30 between the printing stations. However, in this embodiment, the intensity of the electric field E generated between the developing roller 30 and the backing electrode 44 is different from each other at the printing stations 16*a*, 16*b*, 16*c* and 16*d* by changing the voltage $V_{BE}$ applied to the backing electrode 44 in accordance with the charge quantity of the toner particles 38. Therefore, even if the variance of the retaining force of the printing particles 38 on the developing roller 30 due to the difference of the charge quantity of the toner particles 38 between the printing stations 16*a*, 16*b*, 16*c* and 16*d*, the transferability of the printing particles 38 from the developing roller 30 to the sheet 8 is same at each of the printing stations 16*a*, 16*b*, 16*c* and 16*d*, allowing a desired image density of image to be formed.

Subsequently, the sheet 8 to which the image consists of the layers of the toner particles 38 is formed is transported in the fusing station 18 where the layers of the toner particles 38 are fused and permanently fixed on the sheet 8 and finally fed out onto the final stack station or catch tray 20.

In the aforementioned embodiment, although the voltage VBE applied to the backing electrode 44 is used as the parameter of the intensity of the electric field E between the developing roller 30 and the backing electrode 44, a distance $l_i$ between the backing electrode 44 and the printing head 50 (or a distance between the backing electrode 44 and the developing roller 30) can also be used.

Figure 6:
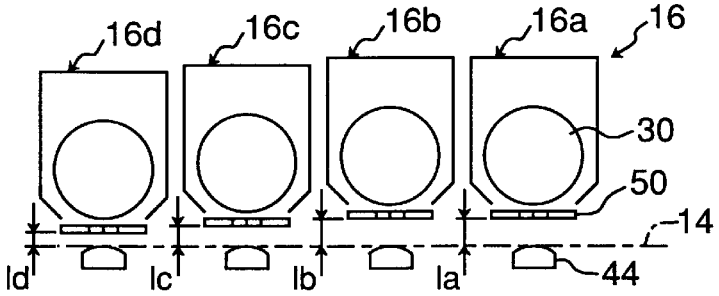
FIG. 6 is a schematic cross-sectional side elevational view of the printing stations showing a condition that a distance between the backing electrode and the printing head is varied in accordance with a charge quantity of particles at each printing station.

For example, as shown in FIG. 6, the distance la, 1b between the backing electrode 44 and the printing head 50 in the upstream-side first and second printing stations 16*a*, 16*b* respectively in which magenta, cyan toner particles 38 of small charge quantity are used respectively are set at same values. The distance lc in the downstream-side third printing stations 16*c* in which yellow toner particles 38 of middle charge quantity is used is set at a smaller value than the distance la, lb in the upstream-side first and second printing stations 16*a*, 16*b*. Moreover, the distance ld in the most downstream-side fourth printing stations 16*d* in which black toner particles 38 of large charge quantity is used is set at a smaller value than the distance lc in the upstream-side third printing stations 16*c*. Therefore, even if the variance of the retaining force of the printing particles 38 on the developing roller 30 due to the difference of the charge quantity of the toner particles 38 between the printing stations 16*a*, 16*b*, 16*c* and 16*d*, the transferability of the printing particles 38 is same at each of the printing stations 16*a*, 16*b*, 16*c* and 16*d*, allowing a desired image density of image to be formed.

In addition to the variance of the retaining force of the printing particles 38 due to the difference in the charge quantity of the toner particles 38 used in the printing stations 16*a*, 16*b*, 16*c* and 16*d*, a variance of the attracting force of the electric field E between the developer sleeve 30 and the backing electrode 44 is caused due to the number of the layers of the printing particles 38 on the sheet 8 at each of the printing stations 16*a*, 16*b*, 16*c* and 16*d*. Therefore, it is also possible to change the intention of the electric field E in accordance with the number of the layer of printing particles in printing stations 16*a*, 16*b*, 16*c* and 16*d*.

Figure 7:
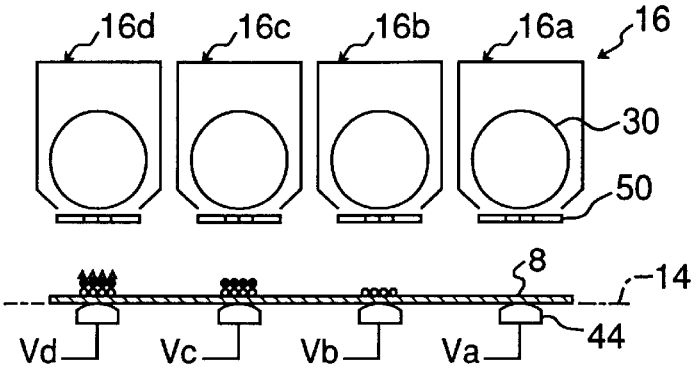
FIG. 7 is a schematic cross-sectional side elevational view of the printing stations showing a condition that a voltage applied to the backing electrode is varied in accordance with the number of the layer of printing particles.
Figure 8:
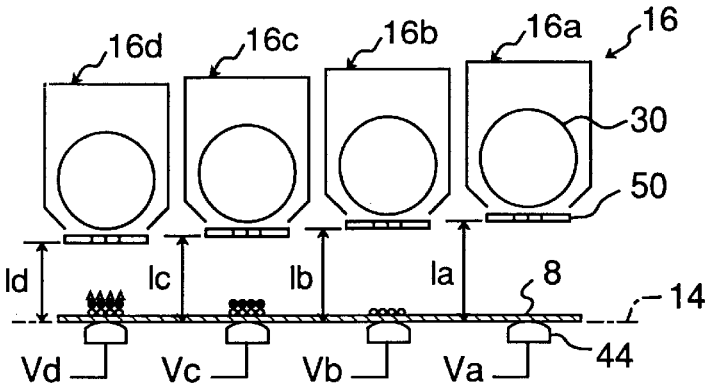
FIG. 8 is a schematic cross-sectional side elevational view of the printing stations showing a condition that a distance between the backing electrode and the printing head is varied in accordance with the number of the layer of printing particles.

For example, as shown in FIG. 7, in the most upstream-side first printing station 16*a*, the voltage Va applied to the backing electrode 44 is set in a small value because there is no layer of the printing particles on the sheet 8. In the downstream-side printing stations 16*b*, 16*c* and 16*d*, the voltage Vb, Vc and Vd applied to the backing electrode 44 are set in a larger value in order of precedence as the number of the layer of the printing particles on the sheet 8 increase. Alternatively, as shown in FIG. 8, in the most upstream-side first printing station 16*a*, the distance la between the backing electrode 44 and the printing head 50 is set in a large value because there is no layer of the printing particles on the sheet 8. In the downstream-side printing stations 16*b*, 16*c* and 16*d*, the distance lb, lc and ld are set in a smaller value in order of precedence as the number of the layer of the printing particles on the sheet 8 increase. Therefore, even if there is the difference in the number of the layers of the toner particles on the sheet in each of the printing stations 16*a*, 16*b*, 16*c* and 16*d*, the variance of the attracting force disappears, the transferability of the printing particles 38 is same at each of the printing stations 16*a*, 16*b*, 16*c* and 16*d*, allowing a desired image density of image to be formed.

Figure 9:
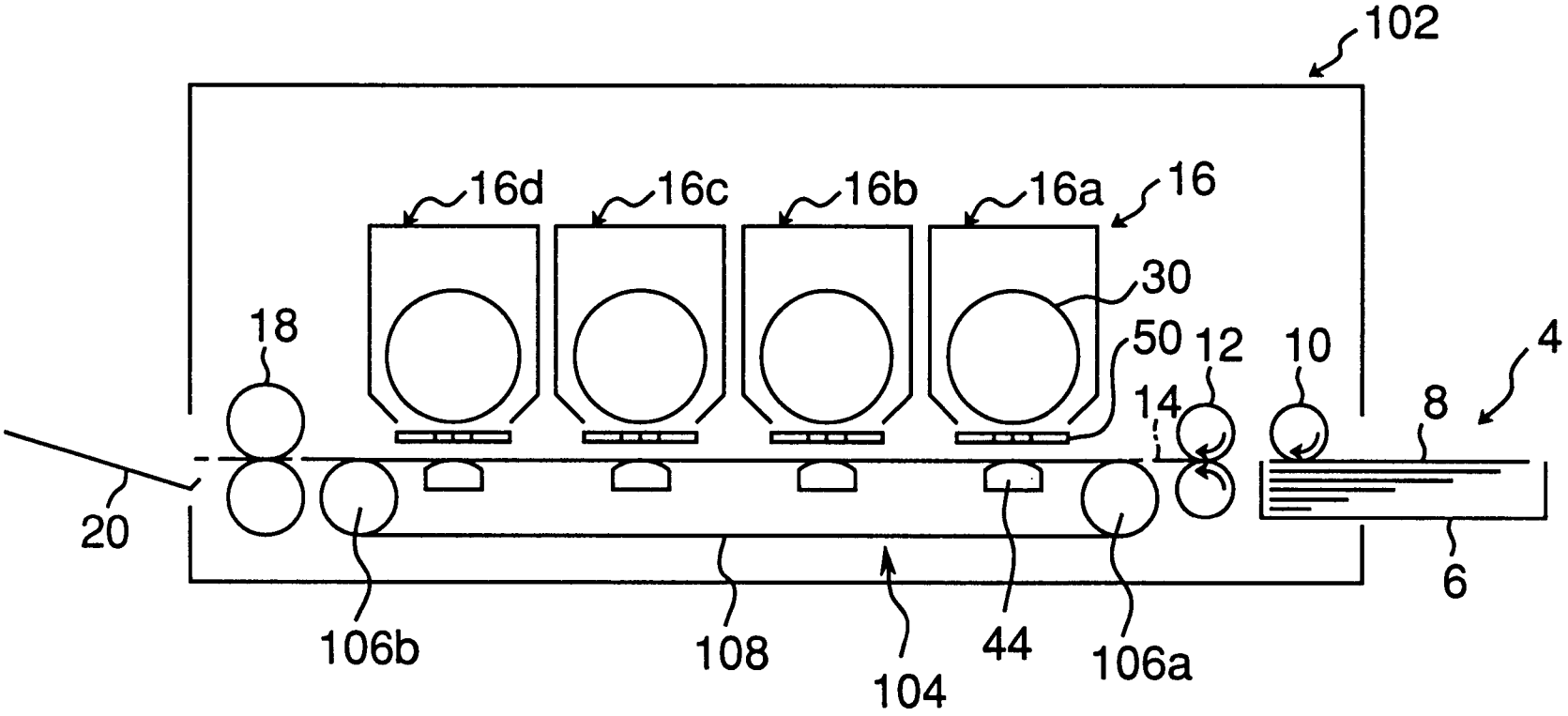
FIG. 9 is a schematic cross-sectional side elevational view of a second embodiment of a tandem type direct printing apparatus of the present invention.

FIG. 9 shows a tandem type of direct printing device 102 according to a second embodiment of the present invention. The direct printing apparatus 102 is same as the tandem type of direct printing apparatus 2 according to the first embodiment as shown in FIG. 1 except that the apparatus 102 is provided with an endless belt type of sheet conveying apparatus 104 in the sheet passage 14. The same numerals are affixed to the same elements as that of the first embodiment and explanations thereof are omitted.

The endless belt type of sheet conveying apparatus 104 comprises a pair of conveyance rollers 106*a*, 106*b* and an endless belt 108 supported on the pair of conveyance rollers 106*a*, 106*b*. The sheet conveying apparatus 104 has an upper belt portion positioned along the sheet passage 14 so that the sheet 8 is put thereon and conveyed. Underneath the upper belt portion of the sheet conveying apparatus 104 are disposed the backing electrodes 44 for the printing stations 16*a*, 16*b*, 16*c* and 16*d*.

In the tandem type of direct printing apparatus 102 according to the second embodiment, the intensity of the electric field E between the developing roller 30 and the backing electrode 44 in each of the printing stations 16*a*, 16*b*, 16*c* and 16*d* is different from each other by any one of the methods as shown in FIGS. 5 to 8 of the first embodiment. Therefore, in spite of the variance of the printing particle retaining force and the attracting force between the printing stations 16*a*, 16*b*, 16*c* and 16*d* a high transferability is obtained, allowing a desired image density of image to be formed.

Figure 10:
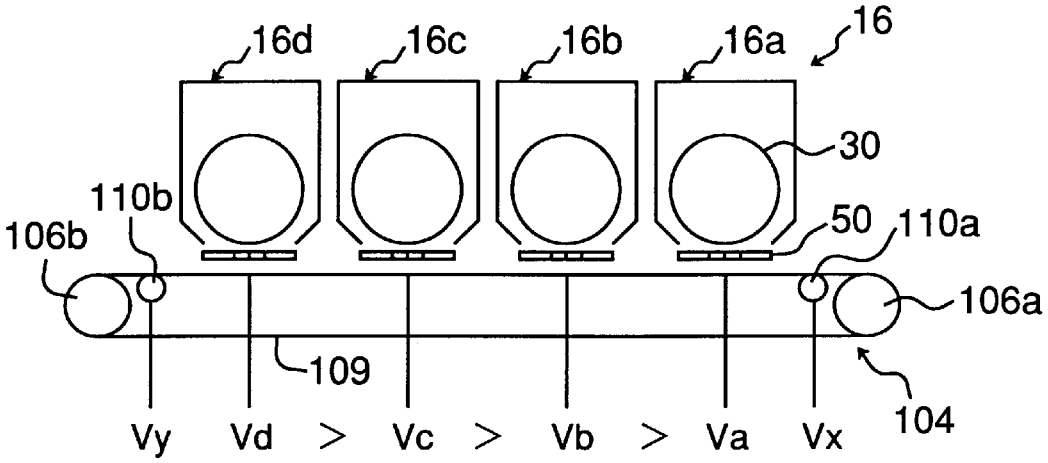
FIG. 10 is a schematic cross-sectional side elevational view of a variation of the printing stations in FIG. 9.

FIG. 10 shows a variation of the tandem type of direct printing device 102 of the second embodiment as shown in FIG. 9. In this variation, each of the printing stations 16*a*, 16*b*, 16*c* and 16*d* does not have a backing electrode. Instead, the endless belt 109 is made of electrical resistance material such as fluoroplastic having electroconductivity and the inner surface of the both ends of the upper belt portion thereof is brought into contact with electric terminals 11*a* and 10*b* respectively. The electric terminals 110*a* and 110*b* are applied with Vx, Vy volts of voltage (Vx<Vy) so that the belt portions opposed to the developing rollers 30 in the printing stations 16*a*, 16*b*, 16*c* and 16*d* are applied with partial voltage Va, Vb, Vc and Vd of the potential difference between the electrodes 110*a*, 10*b*. The partial voltage Va, Vb, Vc and Vd are different in accordance with the toner particles charge quantity and the number of the layer of the toner particles in each of the printing stations 16*a*, 16*b*, 16*c* and 16*d*. Therefore, also in this variation, in spite of the variance of the printing particle retaining force and the attracting force between the printing stations 16*a*, 16*b*, 16*c* and 16*d* a high transferability is obtained, allowing a desired image density of image to be formed.

Figure 11:
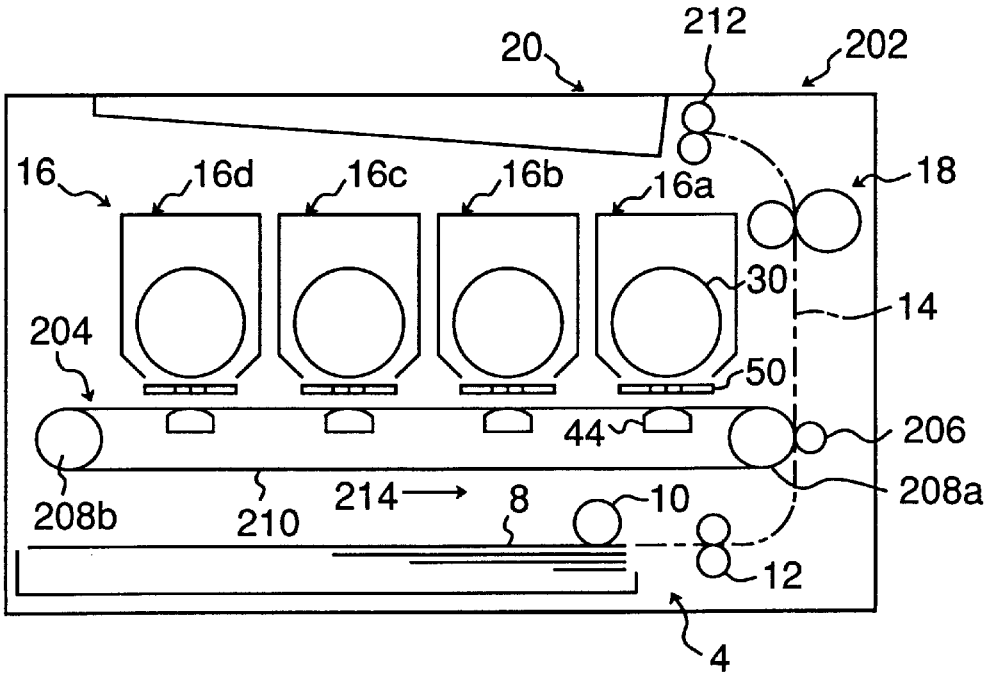
FIG. 11 is a schematic cross-sectional side elevational view of a third embodiment of a tandem type direct printing apparatus of the present invention.

FIG. 11 shows a tandem type of direct printing device 202 according to a third embodiment of the present invention. The direct printing apparatus 202 is same as the tandem type of direct printing apparatus 2 according to the first embodiment as shown in FIG. 1 except that the sheet feed station 4 is positioned on the lower part of the printing station 16, that the fusing station 18 and the stack station 20 are positioned on the side part and the upper part of the printing station 16 respectively, and that an intermediate transfer belt 204 and a transfer roller 206 are provided. The same numerals are affixed to the same elements as that of the first embodiment and explanations thereof are omitted.

The intermediate transfer belt 204 comprises a pair of conveyance rollers 208*a*, 208*b* and an endless belt 210 supported on the pair of conveyance rollers 208*a*, 208*b*. The intermediate transfer belt 204 has an upper belt portion positioned between the developing roller 30 and the backing electrode 44. Underneath the upper belt portion of the intermediate transfer belt 204 are disposed the backing electrodes 44 for the printing stations 16*a*, 16*b*, 16*c* and 16*d* so that the layers of the toner particles are formed on the intermediate transfer belt 204. The intermediate transfer roller 204 is made of electrical resistance material such as fluoroplastic having electroconductivity. The transfer roller 206 is brought into contact with the belt portion of the endless belt 210 positioned at the one conveyance roller 208*b*.

In the tandem type of direct printing apparatus, the sheet passage 14 is formed in the vertical direction from the sheet feed roller 10 of the sheet feed station 4, via a gap between the transfer roller 206 and the belt portion of the endless belt 210 on the conveyance roller 208*b*, through the fusing station 18 to the discharge roller 212 of the stack station 20. An image consisting of layers of toner particles formed on the intermediate transfer roller 204 by the printing stations 16*a*, 16*b*, 16*c* and 16*d* is conveyed in the direction of arrow 214 and transferred to the sheet 8 fed from the sheet feed roller 10 at the opposed portion of the conveying roller 208*a* and the transfer roller 206. The sheet 8 to which the image is transferred is transported to the fusing station 18 where the layers of the toner particles 38 are fused and permanently fixed on the sheet 8 and finally fed out onto the catch tray 20 through the discharge roller 212.

In the tandem type of direct printing apparatus 202 according to the third embodiment, the intensity of the electric field E between the developing roller 30 and the backing electrode 44 in each of the printing stations 16*a*, 16*b*, 16*c* and 16*d* is different from each other by any one of the methods as shown in FIGS. 5 to 8 of the first embodiment or the method as shown in FIG. 10 of the second embodiment. Therefore, in spite of the variance of the printing particle retaining force and the attracting force between the printing stations 16*a*, 16*b*, 16*c* and 16*d* a high transferability is obtained, allowing a desired image density of image to be formed.

Figure 12:
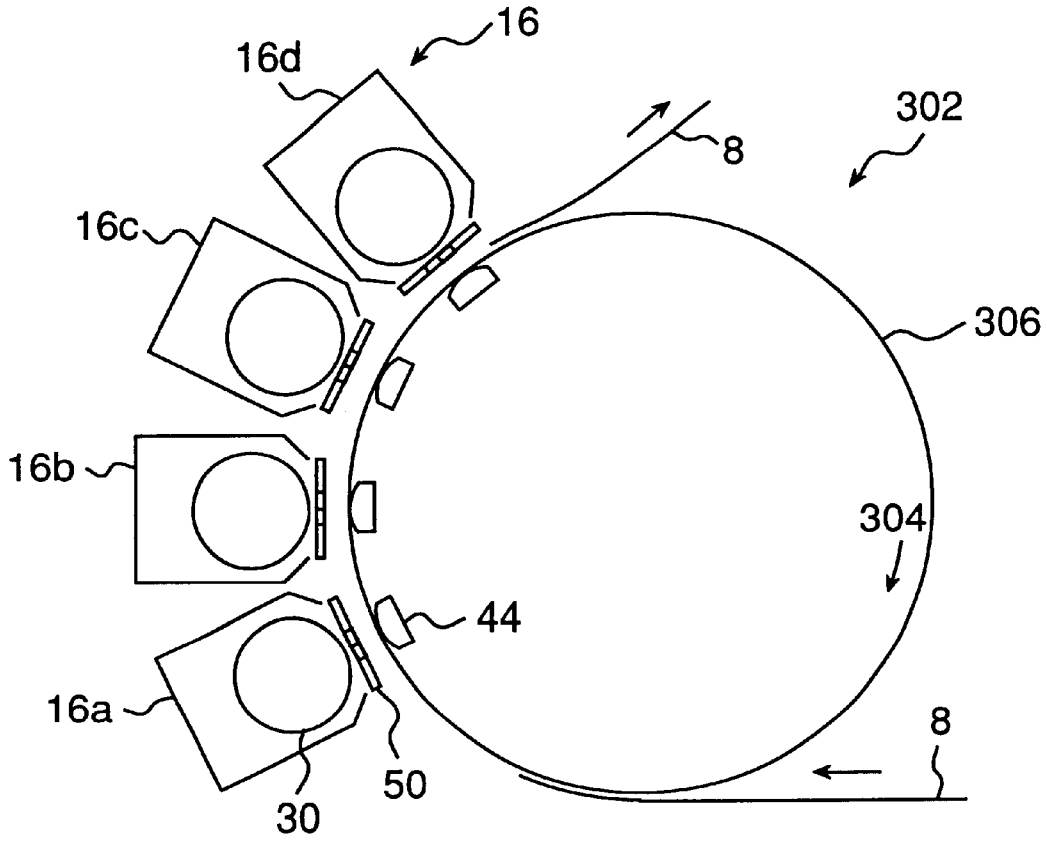
FIG. 12 is a schematic cross-sectional side elevational view of a fourth embodiment of a tandem type direct printing apparatus of the present invention.

FIG. 12 shows a tandem type of direct printing device 302 according to a fourth embodiment of the present invention. The direct printing apparatus 302 is same as the tandem type of direct printing apparatus 2 according to the first embodiment as shown in FIG. 1 except that a conveyance drum 306 rotatably operated in the direction of arrow 304 is provided as a sheet conveying apparatus, and that the printing stations 16*a*, 16*b*, 16*c* and 16*d* are positioned along the outer surface of the conveyance drum 306. In this direct printing device 302, the sheet 8 fed from an unshown sheet feed station is transported on the conveyance drum 306 as the conveyance drum 306 rotates and then the layers of the toner particles is adhered on the sheet 8 by the printing stations 16*a*, 16*b*, 16*c* and 16*d* to form an image. The sheet 8 with the image formed thereon is apart from the conveyance drum 306 and discharged to the discharge station through an unshown fusing station.

Figure 13:
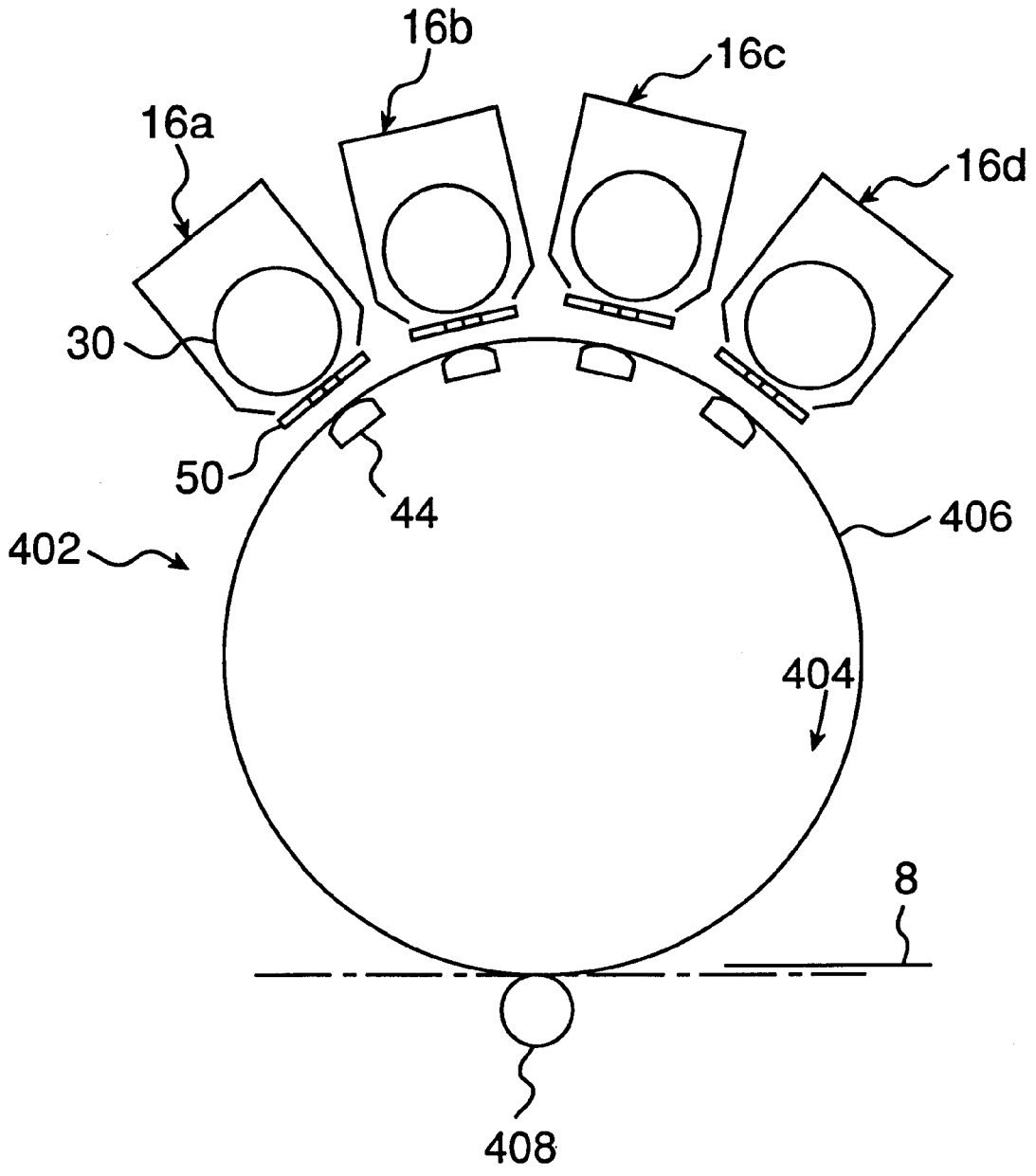
FIG. 13 is a schematic cross-sectional side elevational view of a fifth embodiment of a tandem type direct printing apparatus of the present invention.

FIG. 13 shows a tandem type of direct printing device 402 according to a fifth embodiment of the present invention. The direct printing apparatus 402 is same as the tandem type of direct printing apparatus 202 according to the first embodiment as shown in FIG. 11 except that an intermediate transfer drum 406 rotatably operated in the direction of arrow 404 is provided as an intermediate transfer means, that the printing stations 16*a*, 16*b*, 16*c* and 16*d* are positioned along the outer surface of the intermediate transfer drum 406, and that a transfer roller 408 which comes into contact with the intermediate transfer drum 406 is provided. In this direct printing device 402, an image consisting of layers of toner particles formed on the intermediate transfer drum 406 by the printing stations 16*a*, 16*b*, 16*c* and 16*d* is conveyed in the direction of arrow 404 and transferred to the sheet 8 fed from an unshown sheet feed station at the opposed portion of the intermediate transfer drum 406 and the transfer roller 408. The sheet 8 to which the image is discharged to the discharge station through an unshown fusing station.

In the tandem type of direct printing apparatuses 302, 402 of FIGS. 12 and 13, the intensity of the electric field E between the developing roller 30 and the backing electrode 44 in each of the printing stations 16*a*, 16*b*, 16*c* and 16*d* is different from each other by any one of the methods as shown in FIGS. 5 to 8 of the first embodiment or the method as shown in FIG. 10 of the second embodiment. Therefore, in spite of the variance of the printing particle retaining force and the attracting force between the printing stations 16*a*, 16*b*, 16*c* and 16*d* a high transferability is obtained, allowing a desired image density of image to be formed.

It is to be understand that any type of developing device capable of being employed in the electrophotographic image forming apparatus can be used instead of the developing device 24 as shown in FIG. 2 of the direct printing apparatuses 2, 102, 202, 302 and 402 in the aforementioned embodiments.

Further, the backing electrode 44 may be a roller made of electrically conductive material.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A tandem type direct printing apparatus comprising a plurality of printing stations for depositing printing particles on a print medium to form a layer of printing particles, the plurality of printing stations being positioned in a moving direction of the print medium, the printing station positioned downstream with respect to the moving direction of the print medium forming a layer of printing particles on a layer of printing particles formed by the printing station positioned upstream, the printing station comprising:

a bearing member for bearing charged printing particles thereon;

a backing electrode opposed to the bearing member;

a power supply connected to the backing electrode for generating an electric field that attract the charged printing particles on the bearing member to propel the charged printing particles toward said backing electrode;

a printing head disposed between the bearing member and the backing electrode, the printing head having a plurality of apertures through which the printing particles can propel and a plurality of electrodes disposed around the plurality of apertures; and a driver for applying the plurality of electrode with a voltage for allowing the printing particles to be propelled and a voltage for forbidding the printing particles to be propelled in response to an image signal;

wherein at least any one of the printing stations is different in intention of the electric field from another in accordance with a charge quantity of printing particles or a number of the layer of printing particles in the one of the printing stations.

2. A tandem type direct printing apparatus as claimed in claim 1, wherein the intention of the electric field in each printing stations is different from one another by changing the voltage applied to the backing electrode by the power supply.

3. A tandem type direct printing apparatus as claimed in claim 1, wherein the intention of the electric field in each printing stations is different from one another by changing the distance between the backing electrode and the printing head.

4. A tandem type direct printing apparatus as claimed in any one of the preceding claims, wherein the printing medium is a sheet which is conveyed through a pass formed between the backing electrode and the printing head.

5. A tandem type direct printing apparatus as claimed in claim 4, wherein the sheet is conveyed by an endless belt type of conveyance belt.

6. A tandem type direct printing apparatus as claimed in claim 4, wherein the sheet is conveyed by conveyance drum.

7. A tandem type direct printing apparatus as claimed in claim 1, wherein the printing medium is an intermediate transfer member which is conveyed through a pass formed between the backing electrode and the printing head and wherein the apparatus further comprises a transfer roller which comes into pressure contact with the intermediate transfer roller to transfer the layer of printing particles formed on the intermediate transfer roller onto a sheet.

8. A tandem type direct printing apparatus as claimed in claim 7, wherein the intermediate transfer member is an endless belt type of intermediate transfer belt.

9. A tandem type direct printing apparatus as claimed in claim 7, wherein the intermediate transfer member is an intermediate transfer drum.

* * * * *